US011348550B2

(12) United States Patent
Chen

(10) Patent No.: US 11,348,550 B2
(45) Date of Patent: May 31, 2022

(54) DRIVING METHOD OF DISPLAY PANEL AND DISPLAY DEVICE

(71) Applicants: HKC Corporation Limited, Guangdong (CN); Chongqing HKC Optoelectronics Technology Co., Ltd., Chongqing (CN)

(72) Inventor: Yu-Jen Chen, Chongqing (CN)

(73) Assignees: HKC CORPORATION LIMITED, Shenzhen (CN); CHONGQING HKC OPTOELECTRONICS TECHNOLOGY CO., LTD., Chongqing (CN)

( * ) Notice: Subject to any disclaimer, the term of this patent is extended or adjusted under 35 U.S.C. 154(b) by 0 days.

(21) Appl. No.: 16/612,084

(22) PCT Filed: Aug. 31, 2017

(86) PCT No.: PCT/CN2017/099904
§ 371 (c)(1),
(2) Date: Nov. 8, 2019

(87) PCT Pub. No.: WO2018/205462
PCT Pub. Date: Nov. 15, 2018

(65) Prior Publication Data

US 2020/0118513 A1 Apr. 16, 2020

(30) Foreign Application Priority Data

May 10, 2017 (CN) ..... 201710329662.7

(51) Int. Cl.
*G09G 3/36* (2006.01)

(52) U.S. Cl.
CPC ..... *G09G 3/3696* (2013.01); *G09G 3/3607* (2013.01); *G09G 2320/0233* (2013.01)

(58) Field of Classification Search
None
See application file for complete search history.

(56) References Cited

U.S. PATENT DOCUMENTS

2007/0241989 A1* 10/2007 Kim ..... G09G 3/3648 345/3.1
2009/0322802 A1* 12/2009 Noguchi ..... G09G 3/2003 345/694

(Continued)

FOREIGN PATENT DOCUMENTS

CN 102254535 A 11/2011
CN 102879966 A 1/2013

(Continued)

*Primary Examiner* — Ifedayo B Iluyomade
(74) *Attorney, Agent, or Firm* — Muncy, Geissler, Olds & Lowe, P.C.

(57) ABSTRACT

A driving method of a display panel, comprising: dividing pixels into a plurality of pairs of pixel sets comprising a first pixel set and a second pixel set comprising different color sub-pixels; acquiring a first voltage signal and a second voltage signal, wherein the frame comprises a first frame and a second frame at neighboring timings; adopting the first voltage signals to drive the color sub-pixels of the first pixel set, and adopting the second voltage signals to drive the color sub-pixels of the second pixel set upon displaying the first frame; and adopting the second voltage signals to drive the color sub-pixels of the first pixel set, and adopting the first voltage signals to drive the color sub-pixels of the second pixel set upon displaying the second frame.

15 Claims, 5 Drawing Sheets

(56) References Cited

U.S. PATENT DOCUMENTS

| | | | | |
|---|---|---|---|---|
| 2013/0044142 | A1* | 2/2013 | Kang | G09G 3/3648 345/89 |
| 2014/0152640 | A1* | 6/2014 | Chen | G09G 3/3607 345/212 |

FOREIGN PATENT DOCUMENTS

| | | | |
|---|---|---|---|
| CN | 106991983 | A | 7/2017 |
| WO | WO2016197450 | A1 | 12/2016 |

* cited by examiner

DRIVING METHOD OF DISPLAY PANEL AND DISPLAY DEVICE

CROSS REFERENCE TO RELATED APPLICATIONS

This Non-provisional application claims priority under 35 U.S.C. § 119(a) on Patent Application No(s). 201710329662.7, entitled "DISPLAY DEVICE AND DRIVING METHOD OF DISPLAY PANEL", filed in People's Republic of China on May 10, 2017, the entire contents of which are hereby incorporated by reference.

BACKGROUND

Technical Field

This disclosure relates to a technical field of a display, and more particularly to a driving method of a display panel, and a display device.

Related Art

Most of current large size LCD display panels adopt the negative type vertical alignment (VA) liquid crystal or in-plane switching (IPS) liquid crystal technology. Compared with the IPS liquid crystal technology, the VA type liquid crystal technology has the advantages of the higher production efficiency and the low manufacturing cost, but the optical property has the more obvious defects. More particularly, the commercial application of the large-size panel needs the presentation of the larger viewing angle, and the VA type liquid crystal is driven to have the brightness fast saturated with the voltage at the large viewing angle, thereby seriously deteriorating the picture quality contrast at the viewing angle and the color shift as compared with the front-view picture quality.

SUMMARY

In view of this, it is necessary to provide a driving method of a display panel and a display device capable of solving the viewing-angle color shift.

The present disclosure provides a driving method of a display panel, comprising: dividing pixels on the display panel into a plurality of pairs of pixel sets; wherein each of the pairs of the pixel sets comprise a first pixel set and a second pixel set neighboring each other, and the first pixel set and the second pixel set respectively comprise different color sub-pixels; acquiring a first voltage signal and a second voltage signal corresponding to each of the sub-pixels according to a frame input signal corresponding to a frame and a predetermined rule; wherein the first voltage signal is unequal to the second voltage signal, and the first voltage signal and the second voltage signal alternately drive the sub-pixel to reach a positive viewing-angle mixed brightness equivalent to a positive viewing-angle brightness of the sub-pixel driven by the frame input signal; and the frame comprises a first frame and a second frame at neighboring timings; adopting the first voltage signals for the color sub-pixels corresponding to the first pixel set to respectively drive the color sub-pixels of the first pixel set, and adopting the second voltage signals for the color sub-pixels corresponding to the first pixel set to respectively drive the color sub-pixels of the second pixel set upon displaying the first frame; and adopting the second voltage signals for the color sub-pixels corresponding to the second pixel set to respectively drive the color sub-pixels of the first pixel set, and adopting the first voltage signals for the color sub-pixels corresponding to the second pixel set to respectively drive the color sub-pixels of the second pixel set upon displaying the second frame.

The present disclosure provides a display device comprising a display panel and a drive chip. The pixels on the display panel are divided into a plurality of pairs of pixel sets. Each of the pairs of the pixel sets comprise a first pixel set and a second pixel set neighboring each other, and the first pixel set and the second pixel set respectively comprise different color sub-pixels. The drive chip acquires a first voltage signal and a second voltage signal corresponding to each of the sub-pixels according to a frame input signal corresponding to a frame and a predetermined rule. The frame comprises a first frame and a second frame at neighboring timings. Upon displaying the first frame, the drive chip further adopts the first voltage signals for the color sub-pixels corresponding to the first pixel set to respectively drive the color sub-pixels of the first pixel set, and adopts the second voltage signals for the color sub-pixels corresponding to the first pixel set to respectively drive the color sub-pixels of the second pixel set. Upon displaying the second frame, the drive chip further adopts the second voltage signals for the color sub-pixels corresponding to the second pixel set to respectively drive the color sub-pixels of the first pixel set, and adopts the first voltage signals for the color sub-pixels corresponding to the second pixel set to respectively drive the color sub-pixels of the second pixel set. The first voltage signal is unequal to the second voltage signal, and the first voltage signal and the second voltage signal alternately drive the sub-pixel to reach a positive viewing-angle mixed brightness equivalent to a positive viewing-angle brightness of the sub-pixel driven by the frame input signal.

The present disclosure also provides a driving method of a display panel, comprising: dividing pixels on the display panel into a plurality of pairs of pixel sets; wherein each of the pairs of the pixel sets comprise a first pixel set and a second pixel set neighboring each other, and the first pixel set and the second pixel set respectively comprise different color sub-pixels; wherein the first pixel set and the second pixel set are disposed in the same row and neighbor upon each other or disposed in the same column and neighbor upon each other; wherein the first pixel set in one pair of the pixel sets of the neighboring two pairs of the pixel sets and the second pixel set in the other pair of the pixel sets of the neighboring two pairs of the pixel sets neighbor upon each other; acquiring a first voltage signal and a second voltage signal corresponding to each of the sub-pixels according to a frame input signal corresponding to a frame and a predetermined rule; wherein the first voltage signal is unequal to the second voltage signal, and the first voltage signal and the second voltage signal alternately drive the sub-pixel to reach a positive viewing-angle mixed brightness equivalent to a positive viewing-angle brightness of the sub-pixel driven by the frame input signal; and the frame comprises a first frame and a second frame at neighboring timings; adopting the first voltage signals for the color sub-pixels corresponding to the first pixel set to respectively drive the color sub-pixels of the first pixel set, and adopting the second voltage signals for the color sub-pixels corresponding to the first pixel set to respectively drive the color sub-pixels of the second pixel set upon displaying the first frame; and adopting the second voltage signals for the color sub-pixels corresponding to the second pixel set to respectively drive the color sub-pixels of the first pixel set, and adopting the first voltage signals for the color sub-pixels corresponding to the second pixel set to respectively drive the color sub-pixels of the second pixel set upon displaying the second frame.

In the above-mentioned driving method and display device, the color sub-pixels of the first pixel set and the second pixel set of the first frame are respectively driven by one high voltage signal and one low voltage signal, and the color sub-pixels of the first pixel set and the second pixel set of the second frame are respectively driven by one low voltage signal and one high voltage signal. The low voltage signal improves the drawback of the color difference caused by the refractivity mismatch of the large viewing angle of the display panel, and the high voltage signal keeps the frame resolution. Although each of the first frame and the second frame sacrifices one half of the original frame signal, the equivalent effect of the resolution seen in the space is not sacrificed due to the ordered presentation of the original frame signals on the timings at neighboring positions. This disclosure is particularly applicable to the TN, OCB and the VA type liquid crystal display panel, wherein the processes of this method are simple, and the production yield is high.

BRIEF DESCRIPTION OF THE DRAWINGS

The embodiments will become more fully understood from the detailed description and accompanying drawings, which are given for illustration only, and thus are not limitative of the present invention, and wherein.

DETAILED DESCRIPTION OF THE INVENTION

The embodiments of the invention will be apparent from the following detailed description, which proceeds with reference to the accompanying drawings, wherein the same references relate to the same elements.

Figure 1:
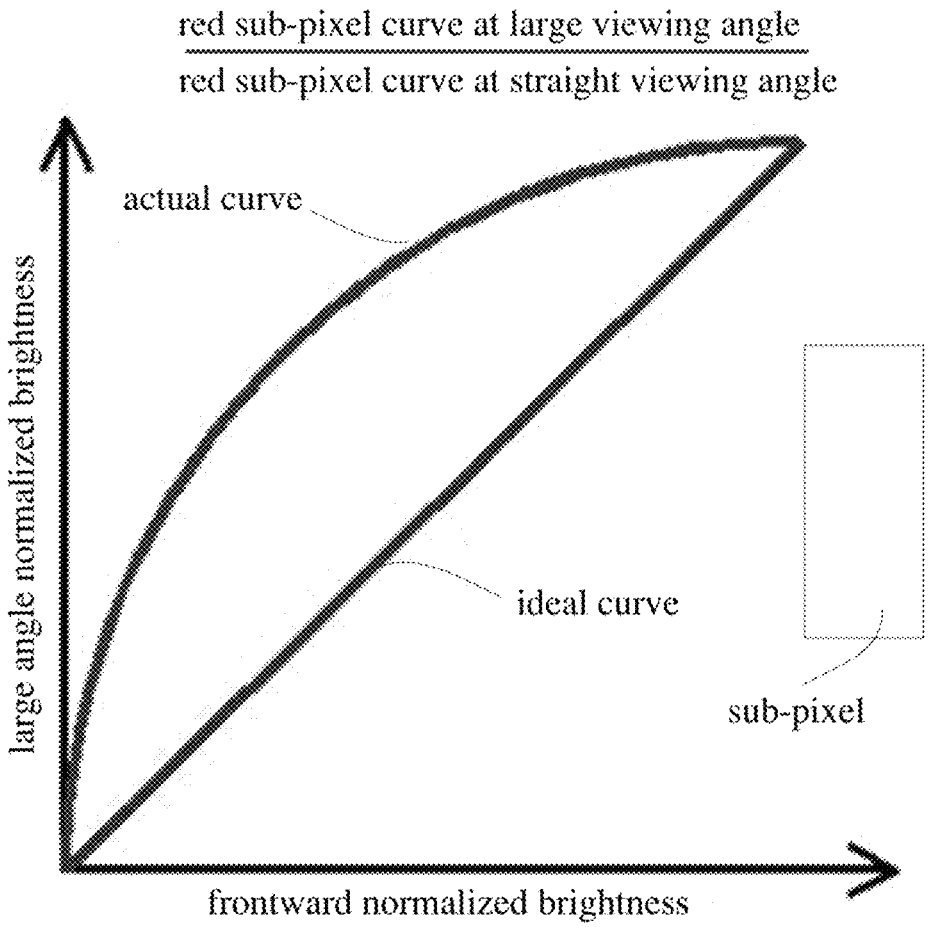
FIG.1 (Prior Art)
FIG. 1 is a graph showing a pixel at a front view and a large angle in the conventional VA type liquid crystal technology.
Figure 2:
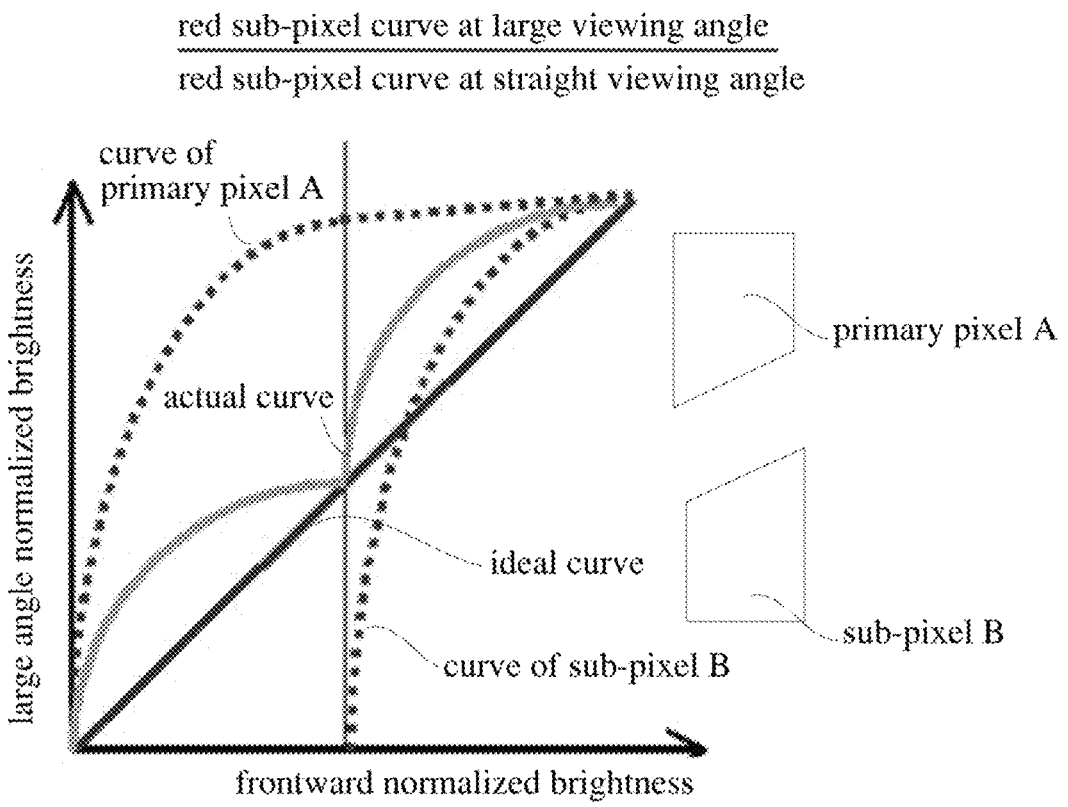
FIG.2(Prior Art)
FIG. 2 is a graph showing a primary pixel and a secondary pixel at a front view and a large angle in the conventional VA type liquid crystal technology.
Figure 3:
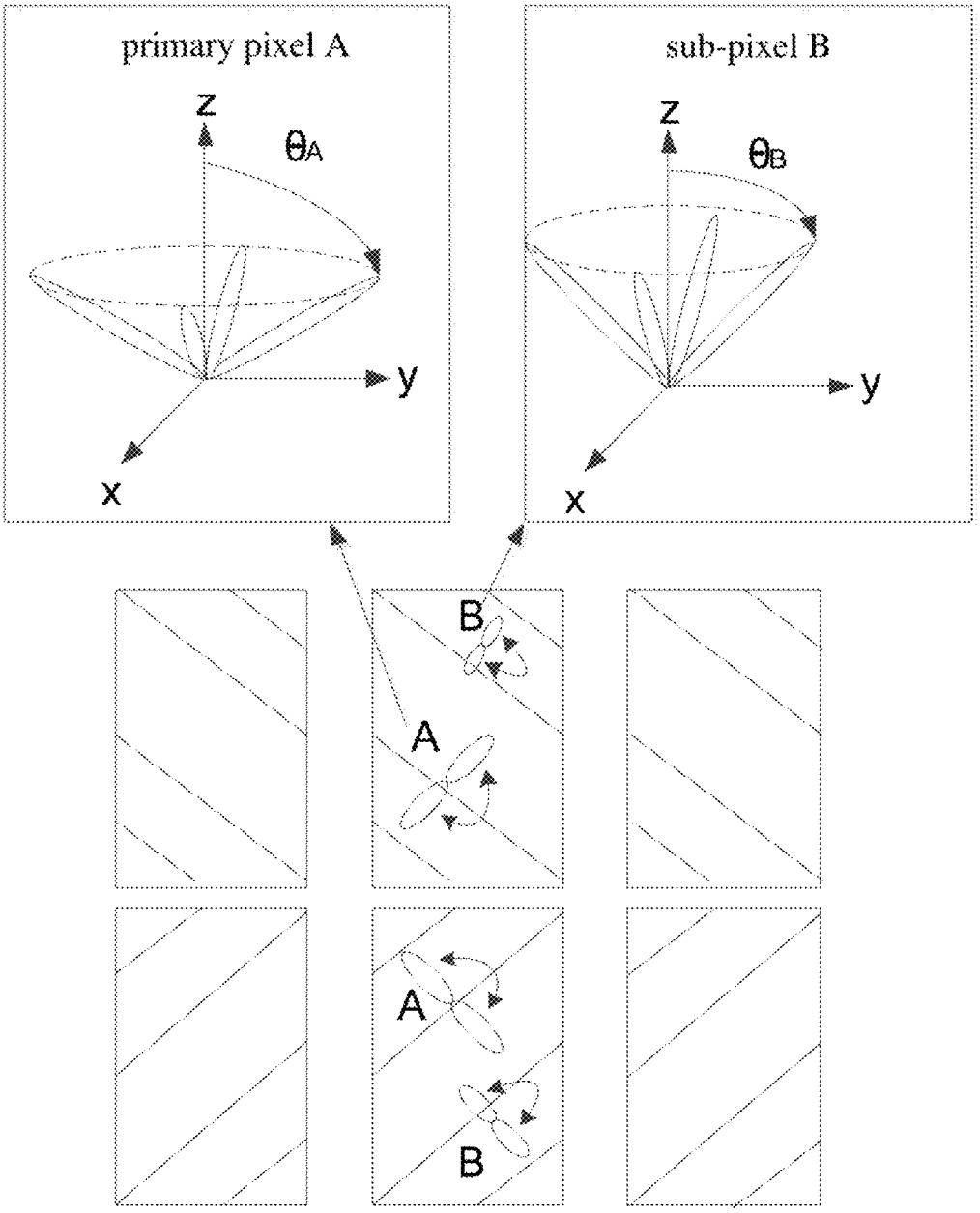
FIG.3 (Prior Art)
FIG. 3 is a schematic view showing motions of liquid crystal molecules in the conventional VA type liquid crystal technology.

Referring to FIG. 1, the conventional VA type liquid crystal is driven to have the brightness fast saturated with the voltage at the large viewing angle, thereby seriously deteriorating the picture quality contrast at the viewing angle and the color shift as compared with the front-view picture quality. In order to solve the viewing-angle color shift in the VA type liquid crystal technology, each of the R, G and B sub-pixels is divided into a primary pixel and a secondary pixel. Then, different driving voltages are applied to the primary pixel and the secondary pixel in the space. FIG. 2 shows a graph when the sub-pixel is divided into the primary pixel and the secondary pixel. It is obtained that dividing the sub-pixel into the primary pixel and the secondary pixel can effectively solve the defect of the viewing-angle color shift, so that the overall large viewing angle brightness is closer to that of the front view with the change of the voltage. FIG. 3 is a schematic view showing motions of the pixel molecules of the RGB sub-pixel liquid crystal molecules in the low gray scale, the middle gray scale and the high gray scale, wherein the motions of the primary pixel A and the secondary pixel B of the liquid crystal molecules of the green sub-pixel G in the middle gray scale are shown in FIG. 3. However, such the pixel design needs a metal layout or a TFT element to be designed to drive the secondary pixel, thereby sacrificing the light-permeable opening region, affecting the permeability of the panel, and directly increasing the backlight cost.

Figure 4:
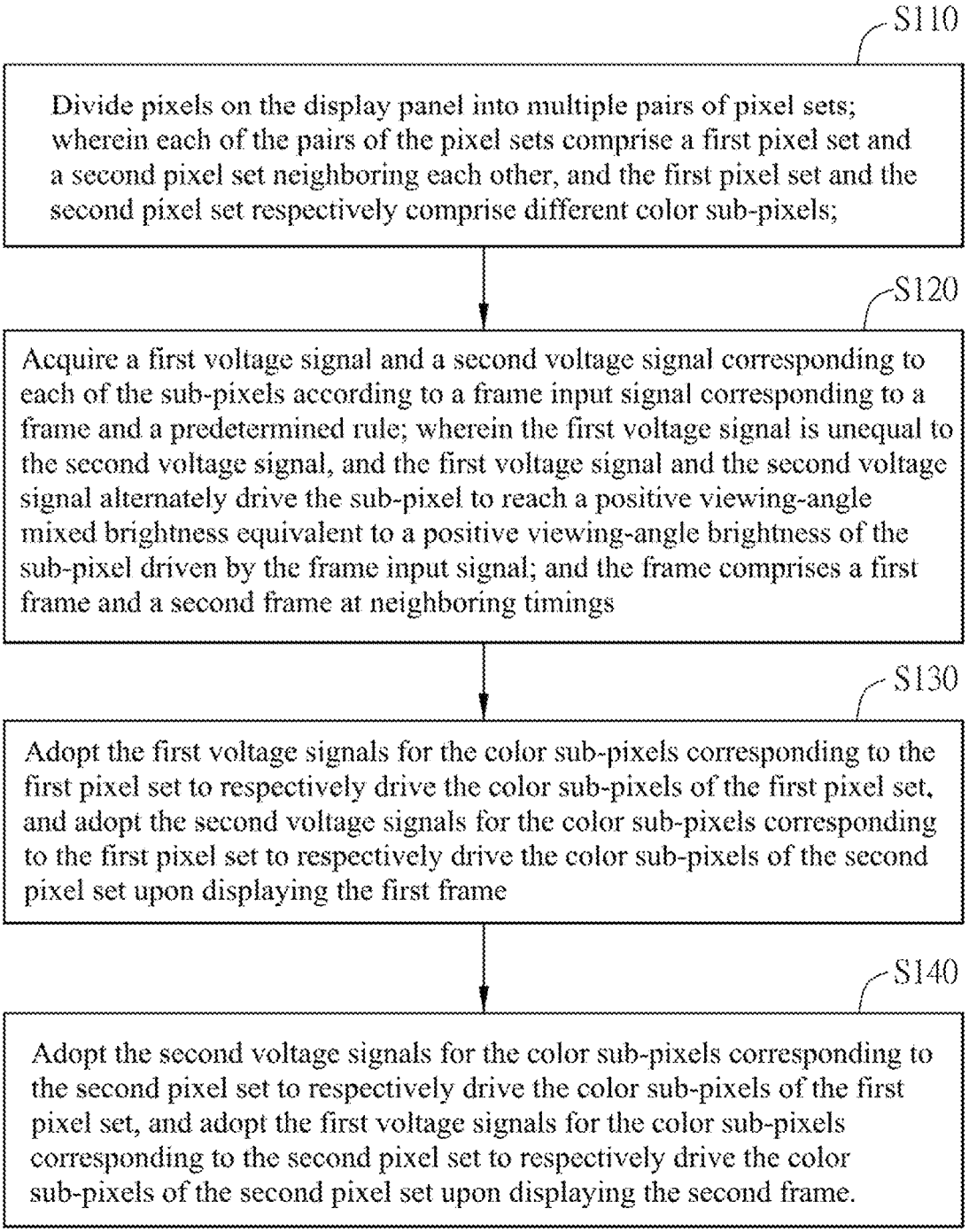
FIG. 4 is a flow chart showing a driving method of a display panel in an embodiment.

Referring to FIG. 4, in order to solve the above-mentioned problems, an embodiment provides a driving method of a display panel. The driving method includes the following steps.

In a step S110, pixels on the display panel are divided into a plurality of pairs of pixel sets, wherein each of the pairs of the pixel sets include a first pixel set and a second pixel set neighboring each other, and the first pixel set and the second pixel set respectively include different color sub-pixels.

In a step S120, a first voltage signal and a second voltage signal corresponding to each of the sub-pixels are acquired according to a frame input signal corresponding to a frame and a predetermined rule, wherein the first voltage signal is unequal to the second voltage signal, and the first voltage signal and the second voltage signal alternately drive the sub-pixel to reach a positive viewing-angle mixed brightness equivalent to a positive viewing-angle brightness of the sub-pixel driven by the frame input signal; and the frame includes a first frame and a second frame at neighboring timings.

In a step S130, upon displaying the first frame, the first voltage signals for the color sub-pixels corresponding to the first pixel set are adopted to respectively drive the color sub-pixels of the first pixel set, and the second voltage signals for the color sub-pixels corresponding to the first pixel set are adopted to respectively drive the color sub-pixels of the second pixel set.

In a step S140, upon displaying the second frame, the second voltage signals for the colors of the sub-pixels corresponding to the second pixel set are adopted to respectively drive the color sub-pixels of the first pixel set, and the first voltage signals for the colors of the sub-pixels corresponding to the second pixel set are adopted to respectively drive the color sub-pixels of the second pixel set.

In the above-mentioned driving method, upon displaying the first frame, the color sub-pixels of the first pixel set and the second pixel set are respectively driven by one high voltage signal and one low voltage signal; and upon displaying the second frame, the color sub-pixels of the first pixel set and the second pixel set are respectively driven by one low voltage signal and one high voltage signal. The low voltage signal improves the drawback of the color difference caused by the refractivity mismatch of the large viewing angle of the display panel, and the high voltage signal keeps the frame resolution. Although each of the first frame and the second frame sacrifices one half of the original frame signal, the equivalent effect of the resolution seen in the space is not sacrificed due to the ordered presentation of the original frame signals on the timings at neighboring positions. The drawbacks of the viewing-angle color shifts of the twisted nematic (TN), the optically compensated birefringence (OCB) and the vertical alignment (VA) type TFT display panels are solved, and the image resolution can also be maintained. The resolution of the same frame is reduced by one half, and the high voltage signal and the low voltage signal present one half of the signal of the frame to obtain the viewing angle compensation effect. The neighboring next frame sacrifices the other half of the resolution of the original frame, and the signal left in the frame is the original frame pixel signal sacrificed in the previous frame. Two frame high voltage signals are presented in neighboring positions according to timings, so that the equivalent resolution can be observed.

In a step S120, a first voltage signal and a second voltage signal corresponding to each of the sub-pixels are acquired according to a frame input signal corresponding to a frame and a predetermined rule, and the first voltage signal and the second voltage signal alternately drive the sub-pixel to reach a positive viewing-angle mixed brightness equivalent to a positive viewing-angle brightness of the sub-pixel driven by the frame input signal.

Specifically, the frame includes a first frame and a second frame at neighboring timings, as listed in Tables 1 and 2.

TABLE 1

| | | | | | | | | |
|---|---|---|---|---|---|---|---|---|
| R1, 1 | G1, 1 | B1, 1 | R1, 2 | G1, 2 | B1, 2 | R1, 3 | G1, 3 | B1, 3 |
| R2, 1 | G2, 1 | B2, 1 | R2, 2 | G2, 2 | B2, 2 | R2, 3 | G2, 3 | B2, 3 |
| R3, 1 | G3, 1 | B3, 1 | R3, 2 | G3, 2 | B3, 2 | R3, 3 | G3, 3 | B3, 3 |
| R4, 1 | G4, 1 | B4, 1 | R4, 2 | G4, 2 | B4, 2 | R4, 3 | G4, 3 | B4, 3 |
| R5, 1 | G5, 1 | B5, 1 | R5, 2 | G5, 2 | B5, 2 | R5, 3 | G5, 3 | B5, 3 |

TABLE 2

| | | | | | | | | |
|---|---|---|---|---|---|---|---|---|
| R' 1, 1 | G' 1, 1 | B' 1, 1 | R' 1, 2 | G' 1, 2 | B' 1, 2 | R' 1, 3 | G' 1, 3 | B' 1, 3 |
| R' 2, 1 | G' 2, 1 | B' 2, 1 | R' 2, 2 | G' 2, 2 | B' 2, 2 | R' 2, 3 | G' 2, 3 | B' 2, 3 |
| R' 3, 1 | G' 3, 1 | B' 3, 1 | R' 3, 2 | G' 3, 2 | B' 3, 2 | R' 3, 3 | G' 3, 3 | B' 3, 3 |
| R' 4, 1 | G' 4, 1 | B' 4, 1 | R' 4, 2 | G' 4, 2 | B' 4, 2 | R' 4, 3 | G' 4, 3 | B' 4, 3 |
| R' 5, 1 | G' 5, 1 | B' 5, 1 | R' 5, 2 | G' 5, 2 | B' 5, 2 | R' 5, 3 | G' 5, 3 | B' 5, 3 |

Further, taking the RGB (three-primary-color) display panel as an example, the red sub-pixel will be described. The red sub-pixel signal $R_{i,j}$ is decomposed into a high voltage $RH_{i,j}$ frame and a low voltage $RL_{i,j}$ frame, and the high voltage frame and the low voltage frame are displayed in order at neighboring two timings. The synthesis effect of the high voltage frame and the low voltage frame is equivalent to the brightness of each of sub-pixels of the original frame. The high voltage frame signal and the low voltage frame signal replace the original frame signal to reach the effect of keeping the front-view brightness unchanged at the original image signal brightness. At the side-viewing angle, the high voltage frame and the low voltage frame are displayed at neighboring two timings. According to the low voltage frame viewing angle property, which can be improved as compared with the brightness saturation phenomenon of the original frame, the viewing angle color difference is improved. The green sub-pixel and the blue sub-pixel can use the method the same as the red sub-pixel.

One high and one low first voltage signal and second voltage signal of the red sub-pixel R, the green sub-pixel G, the blue sub-pixel B in the frame input signal are the high and low voltage signals which have been previously given according to the input signals of the red sub-element R, the green sub-element G, the blue sub-element B, are determined according to the need of compensating the viewing angle effect, and are usually recorded inside the display panel in the form of a look-up-table LUT. Further, the look-up-table LUT is recorded inside the hardware cache (frame buffer) of the display panel. Taking the 8-bit driving signal as an example, each of the red sub-pixel R, the green sub-pixel G and the blue sub-pixel B inputs the signal inputs 0 to 255 corresponding to 256 high and low voltage signals in total, and there are 3*256 pairs of high voltage signals RH, GH, BH and low voltage signals RL, GL, BL in total. The look-up-table of the blue sub-pixel is listed in Table 3.

TABLE 3

| input gray | LUT1 | | LUT2 | |
|---|---|---|---|---|
| scale value | BH1 | BL1 | BH2 | BL2 |
| 0 | 0 | 0 | 0 | 0 |
| 1 | 50 | 0 | 40 | 0 |
| 2 | 80 | 5 | 70 | 10 |
| 3 | 100 | 10 | 100 | 35 |
| 4 | 150 | 20 | 180 | 45 |
| 5 | 180 | 40 | 200 | 65 |
| . | . | . | . | . |
| . | . | . | . | . |
| . | . | . | . | . |
| 255 | 255 | 128 | 255 | 160 |

Optionally, the first voltage signal and the second voltage signal corresponding to each of the sub-pixels can be acquired by looking up a table according to the frame input signal corresponding to the frame. The positive viewing-angle mixed brightness of the first voltage signal and the second voltage signal is equivalent to a positive viewing-angle brightness of the frame input signal. Different look-up-tables can be chosen according to different circumstances, such as the average of the original input gray scale values of one pair of the pixel sets, the average of the original input gray scale values of a plurality of pairs of pixel sets and the like. A plurality of look-up-tables can be set according to requirements, such as 2, 5, 10 and the like. Similarly, a plurality of look-up-tables for the red sub-pixel and the green sub-pixel may also be provided.

Further, the large viewing angle brightnesses corresponding to the first voltage signal and the second voltage signal and the positive viewing-angle brightness of the original drive data are as close as possible. In an embodiment, the difference between the first voltage signal and the second voltage signal needs to be greater than a predetermined difference range, thereby ensuring a larger gray scale difference between two gray scale values in the target gray scale value pair. In this embodiment, the large viewing angle can be defined as greater than 60°, or can be customized according to the user's requirement.

In another embodiment, the conversion relationship is obtained according to the input signal of the sub-pixel. The original drive data of each of the sub-pixels correspond to a set of target gray scale value pairs according to the conversion relationship. If the sub-pixel input value is smaller than the first predetermined value, such as 0.2 V, a first coefficient greater than 1 is multiplied to obtain a first voltage signal, and a second coefficient smaller than 1 is multiplied to obtain a second voltage signal. Different first coefficients and second coefficients are obtained according to different sub-pixel input values so that one set of different target gray scale value pairs are obtained.

For example, the first voltage signal is greater than the second voltage signal.

Optionally, as listed in Table 1, the first pixel set of the first frame is R1,1, G1,1, B1,1, and the second pixel set of the first frame is R2,1, G2,1, B2,1. The color sub-pixels of the first pixel set R1,1, G1,1, B1,1 of the first frame are respectively driven by the first voltage signals RH1,1, GH1,1, BH1,1 for the color sub-pixels corresponding to the first pixel set of the first frame; and the color sub-pixels R2,1, G2,1, B2,1 of the second pixel set of the first frame are respectively driven by the second voltage signals RL1,1, GL1,1, BL1,1 for the color sub-pixels corresponding to the first pixel set of the first frame, as listed in Table 4.

Thus, in the first frame, the signals of the second pixel set R2,1, G2,1, B2,1 are sacrificed and the signals of the first pixel set R1,1, G1,1, B1,1 are reserved. Further, after the positions of the first pixel set are replaced with the table-looked-up high voltage signals (i.e., the first voltage signals RH1,1, GH1,1, BH1,1), and the positions of the sacrificed second pixel set are replaced with the table-looked-up low voltage signals (i.e., the second voltage signals RL1,1, GL1,1, BL1,1). The combination manner of the high voltage signal and the low voltage signal improves the viewing angle color difference.

Optionally, as listed in Table 2, the first pixel set of the second frame are R'1,1, G'1,1, B'1,1, and the second pixel set of the second frame are R'2,1, G'2,1, B'2,1. The color sub-pixels R'1,1, G'1,1, B'1,1 of the first pixel set of the second frame are respectively driven by the second voltage signals RL'2,1, GL'2,1, BL'2,1 for the color sub-pixels corresponding to the second pixel set of the second frame; and the color sub-pixels R'2,1, G'2,1, B'2,1 of the second pixel set of the second frame are respectively driven by the first voltage signals RH'2,1, GH'2,1, BH'2,1 for the color sub-pixels corresponding to the second pixel set of the second frame, as listed in Table 5.

Thus, in the second frame, the signals of the first pixel set R'1,1, G'1,1, B'1,1 are sacrificed and the signals of the second pixel set R'2,1, G'2,1, B'2,1 are reserved. Further, after the positions of the second pixel set are replaced with the table-looked-up high voltage signals (i.e., the first voltage signals RH'2,1, GH'2,1, BH'2,1), and after the positions of the sacrificed first pixel set are replaced with the table-looked-up low voltage signals (i.e., the second voltage signals RL'2,1, GL'2,1, BL'2,1). The combination manner of the high voltage signal and the low voltage signal improves the viewing angle color difference.

Although each of the first frame and the second frame sacrifices one half of the original frame signal, the equivalent effect of the resolution seen in the space is not sacrificed due to the ordered presentation of the original frame signals on the timings at neighboring positions.

TABLE 4

| | | | | | | | | |
|---|---|---|---|---|---|---|---|---|
| RH1, 1 | GH1, 1 | BH1, 1 | RL2, 2 | GL2, 2 | BL2, 2 | RH1, 3 | GH1, 3 | BH1, 3 |
| RL1, 1 | GL1, 1 | BL1, 1 | RH2, 2 | GH2, 2 | BH2, 2 | RL1, 3 | GL1, 3 | BL1, 3 |
| RH3, 1 | GH3, 1 | BH3, 1 | RL4, 2 | GL4, 2 | BL4, 2 | RH3, 3 | GH3, 3 | BH3, 3 |
| RL3, 1 | GL3, 1 | BL3, 1 | RH4, 2 | GH4, 2 | BH4, 2 | RL3, 3 | GL3, 3 | BL3, 3 |
| RH5, 1 | GH5, 1 | BH5, 1 | RL6, 2 | GL6, 2 | BL6, 2 | RH5, 3 | GH5, 3 | BH5, 3 |

TABLE 5

| | | | | | | | | |
|---|---|---|---|---|---|---|---|---|
| RL' | GL' | BL' | RH' | GH' | BH' | RL' | GL' | BL' |
| 2, 1 | 2, 1 | 2, 1 | 1, 2 | 1, 2 | 1, 2 | 2, 3 | 2, 3 | 2, 3 |
| RH' | GH' | BH' | RL' | GL' | BL' | RH' | GH' | BH' |
| 2, 1 | 2, 1 | 2, 1 | 1, 2 | 1, 2 | 1, 2 | 2, 3 | 2, 3 | 2, 3 |
| RL' | GL' | BL' | RH' | GH' | BH' | RL' | GL' | BL' |
| 4, 1 | 4, 1 | 4, 1 | 3, 2 | 3, 2 | 3, 2 | 4, 3 | 4, 3 | 4, 3 |

TABLE 5-continued

| | | | | | | | | |
|---|---|---|---|---|---|---|---|---|
| RH' | GH' | BH' | RL' | GL' | BL' | RH' | GH' | BH' |
| 4, 1 | 4, 1 | 4, 1 | 3, 2 | 3, 2 | 3, 2 | 4, 3 | 4, 3 | 4, 3 |
| RL' | GL' | BL' | RH' | GH' | BH' | RL' | GL' | BL' |
| 6, 1 | 6, 1 | 6, 1 | 5, 2 | 5, 2 | 5, 2 | 6, 3 | 6, 3 | 6, 3 |

Optionally, the first pixel set and the second pixel set can be disposed in the same column and neighbor upon each other (that is, longitudinally neighbor upon each other). As listed in Table 1, the first pixel set of the first frame is R1,1, G1,1, B1,1, and the second pixel set of the first frame is R2,1, G2,1, B2,1. As listed in Table 4, in the first frame, the color sub-pixels R1,1, G1,1, B1,1 of the first pixel set are respectively driven by the first voltage signals RH1,1, GH1,1, BH1,1 for the color sub-pixels corresponding to the first pixel set, and the color sub-pixels R2,1, G2,1, B2,1 of the second pixel set are respectively driven by the second voltage signals RL1,1, GL1,1, BL1,1 for the color sub-pixels corresponding to the first pixel set. As listed in Table 5, in the second frame, the color sub-pixels R'1,1, G'1,1, B'1,1 of the first pixel set are respectively driven by the second voltage signals RL'2,1, GL'2,1, BL'2,1 for the color sub-pixels corresponding to the second pixel set, and the color sub-pixels R'2,1, G'2,1, B'2,1 of the second pixel set are respectively driven by the first voltage signals RH'2,1, GH'2,1, BH'2,1 for the color sub-pixels corresponding to the second pixel set. Further, the first pixel set in one pair of the pixel sets of the neighboring two pairs of the pixel sets and the second pixel set in the other pair of the pixel sets of the neighboring two pairs of the pixel sets neighbor upon each other, that is, the first pixel set in one pair of the transversally neighboring two pairs of pixel sets is disposed above the second pixel set, and the first pixel set in the other or another one pair of the pixel sets is disposed below the second pixel set. The first pixel sets for implementing the neighboring pixel sets are staggered.

Optionally, the first pixel set and the second pixel set can be disposed in the same row and neighbor upon each other (that is, transversally neighbor upon each other). As listed in Table 1, the first pixel set of the first frame is R1,1, G1,1, B1,1, and the second pixel set of the first frame is R1,2, G1,2, B1,2. As listed in Table 6, in the first frame, the color sub-pixels R1,1, G1,1, B1,1 of the first pixel set are respectively driven by the first voltage signals RH1,1, GH1,1, BH1,1 for the color sub-pixels corresponding to the first pixel set, and the color sub-pixels R1,2, G1,2, B1,2 of the second pixel set are respectively driven by the second voltage signals RL1,1, GL1,1, BL1,1 for the color sub-pixels corresponding to the first pixel set. As listed in Table 7, in the second frame, the color sub-pixels R'1,1, G'1,1, B'1,1 of the first pixel set are respectively driven by the second voltage signals RL'1,2, GL'1,2, BL'1,2 for the color sub-pixels corresponding to the second pixel set, and the color sub-pixels R'1,2, G'1,2, B'1,2 of the second pixel set are respectively driven by the first voltage signals RH'1,2, GH'1,2, BH'1,2 for the color sub-pixels corresponding to the second pixel set. Further, the first pixel set in one pair of the pixel sets of the neighboring two pairs of the pixel sets and the second pixel set in the other pair of the pixel sets of the neighboring two pairs of the pixel sets neighbor upon each other, that is, the first pixel set in one pair of the pixel sets of the longitudinally neighboring two pairs of pixel sets is disposed on the right side of the second pixel set, and the first pixel set in the other or another one pair of the pixel sets is disposed on the left side of the second pixel set. The first pixel sets for implementing the neighboring pixel sets are staggered.

TABLE 6

| | | | | | | | | |
|---|---|---|---|---|---|---|---|---|
| RH1, 1 | GH1, 1 | BH1, 1 | RL1, 1 | GL1, 1 | BL1, 1 | RH1, 3 | GH1, 3 | BH1, 3 |
| RL2, 2 | GL2, 2 | BL2, 2 | RH2, 2 | GH2, 2 | BH2, 2 | RL2, 4 | GL2, 4 | BL2, 4 |
| RH3, 1 | GH3, 1 | BH3, 1 | RL3, 1 | GL3, 1 | BL3, 1 | RH3, 3 | GH3, 3 | BH3, 3 |
| RL4, 2 | GL4, 2 | BL4, 2 | RH4, 2 | GH4, 2 | BH4, 2 | RL4, 4 | GL4, 4 | BL4, 4 |
| RH5, 1 | GH5, 1 | BH5, 1 | RL5, 1 | GL5, 1 | BL5, 1 | RH5, 3 | GH5, 3 | BH5, 3 |

TABLE 7

| | | | | | | | | |
|---|---|---|---|---|---|---|---|---|
| RL' | GL' | BL' | RH' | GH' | BH' | RL' | GL' | BL' |
| 1, 2 | 1, 2 | 1, 2 | 1, 2 | 1, 2 | 1, 2 | 1, 4 | 1, 4 | 1, 4 |
| RH' | GH' | BH' | RL' | GL' | BL' | RH' | GH' | BH' |
| 2, 1 | 2, 1 | 2, 1 | 2, 1 | 2, 1 | 2, 1 | 2, 3 | 2, 3 | 2, 3 |
| RL' | GL' | BL' | RH' | GH' | BH' | RL' | GL' | BL' |
| 3, 2 | 3, 2 | 3, 2 | 3, 2 | 3, 2 | 3, 2 | 3, 4 | 3, 4 | 3, 4 |
| RH' | GH' | BH' | RL' | GL' | BL' | RH' | GH' | BH' |
| 4, 1 | 4, 1 | 4, 1 | 4, 1 | 4, 1 | 4, 1 | 4, 3 | 4, 3 | 4, 3 |
| RL' | GL' | BL' | RH' | GH' | BH' | RL' | GL' | BL' |
| 5, 2 | 5, 2 | 5, 2 | 5, 2 | 5, 2 | 5, 2 | 5, 4 | 5, 4 | 5, 4 |

In the above-mentioned implementation method, the first voltage signal can be greater than the second voltage signal.

In the above-mentioned implementation method, the positions of the first and second pixel sets in the pixel sets can be exchanged.

The above-mentioned implementation method is adopted, so that the pixels for the high and low voltages co-exist in the same frame. The co-existing of the pixels for the high and low voltages in the neighboring next timing frame is only the position transformation of the high and low voltages, and such the driving effect can decrease the flicker phenomenon caused by different brightnesses of the high and low voltages.

In one embodiment, each of the first pixel set and the second pixel set of the display panel comprises a first sub-pixel, a second sub-pixel, and a third sub-pixel.

Further, the first, second and third sub-pixels are a red sub-pixel, a green sub-pixel, and a blue sub-pixel. Further, each of the first pixel set and the second pixel set on the display panel comprises a red sub-pixel, a green sub-pixel, and a blue sub-pixel.

In one embodiment, the display panel comprises red pixels, green pixels, blue pixels and yellow pixels, and each of the first pixel set and the second pixel set comprises a red sub-pixel, a green sub-pixel, a blue sub-pixel and a yellow sub-pixel.

In one embodiment, the display panel comprises red pixels, green pixels, blue pixels and white pixels, and each of the first pixel set and the second pixel set comprises a red sub-pixel, a green sub-pixel, a blue sub-pixel and a white sub-pixel.

The driving method of the display panel can improve the drawback of the color shift or the color difference caused by the refractivity mismatch of the large viewing angle of the display panel. The display panel may be the TN, OCB or VA type liquid crystal display panel, but is not limited thereto. The display panel may be a RGB (three-primary-color) panel, a RGBW (four-color) panel or a RGBY (four-color) panel, but is not limited thereto. The driving method is similarly applicable to the condition when the display panel is a curved surface panel.

Figure 5:
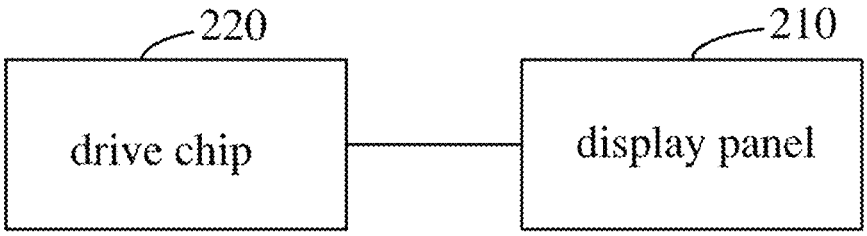
FIG. 5 is a block diagram showing a display device in an embodiment.

Referring to FIG. 5, a display device comprises a display panel 210 and a drive chip 220. The pixels on the display panel 220 are divided into a plurality of pairs of pixel sets. Each of the pairs of the pixel sets comprise a first pixel set and a second pixel set neighboring each other, and the first pixel set and the second pixel set respectively comprise different color sub-pixels.

The drive chip 220 acquires a first voltage signal and a second voltage signal corresponding to each of the sub-pixels according to a frame input signal corresponding to a frame and a predetermined rule. The frame comprises a first frame and a second frame at neighboring timings. Upon displaying the first frame, the drive chip 220 further adopts the first voltage signals for the color sub-pixels corresponding to the first pixel set to respectively drive the color sub-pixels of the first pixel set, and adopts the second voltage signals for the color sub-pixels corresponding to the first pixel set to respectively drive the color sub-pixels of the second pixel set. Upon displaying the second frame, the drive chip 220 further adopts the second voltage signals for the color sub-pixels corresponding to the second pixel set to respectively drive the color sub-pixels of the first pixel set, and adopts the first voltage signals for the color sub-pixels corresponding to the second pixel set to respectively drive the color sub-pixels of the second pixel set. The first voltage signal is unequal to the second voltage signal, and the first voltage signal and the second voltage signal alternately drive the sub-pixel to reach a positive viewing-angle mixed brightness equivalent to a positive viewing-angle brightness of the sub-pixel driven by the frame input signal.

Optionally, the first pixel set and the second pixel set can be disposed in the same column and neighbor upon each other (that is, longitudinally neighbor upon each other). As listed in Table 1, the first pixel set of the first frame is R1,1, G1,1, B1,1, and the second pixel set of the first frame is R2,1, G2,1, B2,1. As listed in Table 4, in the first frame, the color sub-pixels R1,1, G1,1, B1,1 of the first pixel set are respectively driven by the first voltage signals RH1,1, GH1, 1, BH1,1 for the color sub-pixels corresponding to the first pixel set, and the color sub-pixels R2,1, G2,1, B2,1 of the second pixel set are respectively driven by the second voltage signals RL1,1, GL1,1, BL1,1 for the color sub-pixels corresponding to the first pixel set. As listed in Table 5, in the second frame, the color sub-pixels R'1,1, G'1,1, B'1,1 of the first pixel set are respectively driven by the second voltage signals RL'2,1, GL'2,1, BL'2,1 for the color sub-pixels corresponding to the second pixel set, and the color sub-pixels R'2,1, G'2,1, B'2,1 of the second pixel set are respectively driven by the first voltage signals RH'2,1, GH'2,1, BH'2,1 for the color sub-pixels corresponding to the second pixel set. Further, the first pixel set in one pair of the pixel sets of the neighboring two pairs of the pixel sets and the second pixel set in the other pair of the pixel sets of the neighboring two pairs of the pixel sets neighbor upon each other, that is, the first pixel set in one pair of the transversally neighboring two pairs of pixel sets is disposed above the second pixel set, and the first pixel set in the other or another one pair of the pixel sets is disposed below the second pixel set. The first pixel sets for implementing the neighboring pixel sets are staggered.

Optionally, the first pixel set and the second pixel set can be disposed in the same row and neighbor upon each other (that is, transversally neighbor upon each other). As listed in Table 1, the first pixel set of the first frame is R1,1, G1,1, B1,1, and the second pixel set of the first frame is R1,2, G1,2, B1,2. As listed in Table 6, in the first frame, the color sub-pixels R1,1, G1,1, B1,1 of the first pixel set are respectively driven by the first voltage signals RH1,1, GH1,1, BH1,1 for the color sub-pixels corresponding to the first pixel set, and the color sub-pixels R1,2, G1,2, B1,2 of the second pixel set are respectively driven by the second voltage signals RL1,1, GL1,1, BL1,1 for the color sub-pixels corresponding to the first pixel set. As listed in Table 7, in the second frame, the color sub-pixels R'1,1, G'1,1, B'1,1 of the first pixel set are respectively driven by the second voltage signals RL'1,2, GL'1,2, BL'1,2 for the color sub-pixels corresponding to the second pixel set, and the color sub-pixels R'1,2, G'1,2, B'1,2 of the second pixel set are respectively driven by the first voltage signals RH'1,2, GH'1,2, BH'1,2 for the color sub-pixels corresponding to the second pixel set. Further, the first pixel set in one pair of the pixel sets of the neighboring two pairs of the pixel sets and the second pixel set in the other pair of the pixel sets of the neighboring two pairs of the pixel sets neighbor upon each other, that is, the first pixel set in one pair of the pixel sets of the longitudinally neighboring two pairs of pixel sets is disposed on the right side of the second pixel set, and the first pixel set in the other or another one pair of the pixel sets is disposed on the left side of the second pixel set. The first pixel sets for implementing the neighboring pixel sets are staggered.

Optionally, the drive chip 220 can look up a table to acquire the nonequivalent first voltage signal and the second voltage signal corresponding to each of the sub-pixels according to the frame input signal corresponding to the frame. The positive viewing-angle mixed brightness of the first voltage signal and the second voltage signal is equivalent to a positive viewing-angle brightness of the frame input signal. The first voltage signal and the second voltage signal alternately drive the sub-pixel to reach a positive viewing-angle mixed brightness equivalent to a positive viewing-angle brightness of the sub-pixel driven by the frame input signal.

In one embodiment, each of the first pixel set and the second pixel set of the display panel 210 comprises a first sub-pixel, a second sub-pixel, and a third sub-pixel.

Further, the first, second and third sub-pixels are a red sub-pixel, a green sub-pixel, and a blue sub-pixel. Further, each of the first pixel set and the second pixel set on the display panel 210 comprises a red sub-pixel, a green sub-pixel, and a blue sub-pixel.

In one embodiment, the display panel 210 comprises red pixels, green pixels, blue pixels and yellow pixels, and each of the first pixel set and the second pixel set on the display panel 210 comprises a red sub-pixel, a green sub-pixel, a blue sub-pixel and a yellow sub-pixel.

In one embodiment, the display panel 210 comprises red pixels, green pixels, blue pixels and white pixels, and each of the first pixel set and the second pixel set on the display panel 210 comprises a red sub-pixel, a green sub-pixel, a blue sub-pixel and a white sub-pixel.

In one embodiment, a difference between the first voltage signal and the second voltage signal is greater than a predetermined difference range.

The display panel can improve the drawback of the color shift or the color difference caused by the refractivity mismatch of the large viewing angle of the display panel. The display panel may be the TN, OCB or VA type liquid crystal display panel, but is not limited thereto. The display panel may be a RGB (three-primary-color) panel, a RGBW (four-color) panel or a RGBY (four-color) panel, but is not limited thereto. The driving method is similarly applicable to the condition when the display panel is a curved surface panel.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A driving method of a display panel, comprising:

dividing pixels on the display panel into a plurality of pairs of pixel sets; wherein each of the pairs of the pixel sets comprises a first pixel set comprising three different color sub-pixels and a second pixel set comprising three different color sub-pixels, and the first pixel set and the second pixel set neighbor each other;

acquiring, by looking up a table recorded inside a hardware cache of the display panel, a first voltage signal and a second voltage signal corresponding to each of the sub-pixels according to a frame input signal corresponding to a frame and a predetermined rule; wherein the first voltage signal is unequal to the second voltage signal and a difference between the first voltage signal and the second voltage signal is greater than a predetermined difference range; and the first voltage signal and the second voltage signal alternately drive the sub-pixel to reach a positive viewing-angle mixed brightness equivalent to a positive viewing-angle brightness of the sub-pixel driven by the frame input signal; and the frame comprises a first frame and a second frame at neighboring timings;

adopting the first voltage signals for the color sub-pixels corresponding to the first pixel set to respectively drive the color sub-pixels of the first pixel set, and adopting the second voltage signals for the color sub-pixels corresponding to the first pixel set to respectively drive the color sub-pixels of the second pixel set upon displaying the first frame; and adopting the second voltage signals for the color sub-pixels corresponding to the second pixel set to respectively drive the color sub-pixels of the first pixel set, and adopting the first voltage signals for the color sub-pixels corresponding to the second pixel set to respectively drive the color sub-pixels of the second pixel set upon displaying the second frame, wherein, the frame input signal of the sub-pixel is decomposed into a first voltage frame and a second voltage frame, and the first voltage frame and the second voltage frame are displayed in order at neighboring two frames such that the synthesis effect of the first voltage frame and the second voltage frame is equivalent to the brightness of each of the sub-pixels of the original frame.

2. The driving method according to claim 1, wherein the first pixel set and the second pixel set are disposed in the same row and neighbor upon each other.

3. The driving method according to claim 1, wherein the first pixel set and the second pixel set are disposed in the same column and neighbor upon each other.

4. The driving method according to claim 1, wherein the first pixel set in one pair of the pixel sets of the neighboring two pairs of the pixel sets and the second pixel set in the other pair of the pixel sets of the neighboring two pairs of the pixel sets neighbor upon each other.

5. The driving method according to claim 1, wherein each of the first pixel set and the second pixel set comprises a red sub-pixel, a green sub-pixel and a blue sub-pixel.

6. The driving method according to claim 5, wherein each of the first pixel set and the second pixel set further comprises a yellow sub-pixel.

7. The driving method according to claim 5, wherein each of the first pixel set and the second pixel set further comprises a white sub-pixel.

8. A display device, comprising:

a display panel, wherein pixels on the display panel are divided into a plurality of pairs of pixel sets; each of the pairs of the pixel sets comprises a first pixel set comprising three different color sub-pixels and a second pixel set comprising three different color sub-pixels, and the first pixel set and the second pixel set neighbor each other; and a drive chip acquiring, by looking up a table recorded inside a hardware cache of the display panel, a first voltage signal and a second voltage signal corresponding to each of the sub-pixels according to a frame input signal corresponding to a frame and a predetermined rule; wherein the frame comprises a first frame and a second frame at neighboring timings; upon displaying the first frame, the drive chip further adopts the first voltage signals for the color sub-pixels corresponding to the first pixel set to respectively drive the color sub-pixels of the first pixel set, and adopts the second voltage signals for the color sub-pixels corresponding to the first pixel set to respectively drive the color sub-pixels of the second pixel set; and upon displaying the second frame, the drive chip further adopts the second voltage signals for the color sub-pixels corresponding to the second pixel set to respectively drive the color sub-pixels of the first pixel set, and adopts the first voltage signals for the color sub-pixels corresponding to the second pixel set to respectively drive the color sub-pixels of the second pixel set; wherein the first voltage signal is unequal to the second voltage signal and a difference between the first voltage signal and the second voltage signal is greater than a predetermined difference range, and the first voltage signal and the second voltage signal alternately drive the sub-pixel to reach a positive viewing-angle mixed brightness equivalent to a positive viewing-angle brightness of the sub-pixel driven by the frame input signal, wherein, the frame input signal of the sub-pixel is decomposed into a first voltage frame and a second voltage frame, and the first voltage frame and the second voltage frame are displayed in order at neighboring two frames such that the synthesis effect of the first voltage frame and the second voltage frame is equivalent to the brightness of each of the sub-pixels of the original frame.

9. The display device according to claim 8, wherein the first pixel set and the second pixel set of the display panel are disposed in the same row and neighbor upon each other.

10. The display device according to claim 8, wherein the first pixel set and the second pixel set are disposed in the same column and neighbor upon each other.

11. The display device according to claim 8, wherein the first pixel set in one pair of the pixel sets of the neighboring two pairs of the pixel sets of the display panel and the second pixel set in the other pair of the pixel sets of the neighboring two pairs of the pixel sets of the display panel neighbor upon each other.

12. The display device according to claim 8, wherein each of the first pixel set and the second pixel set of the display panel comprises a red sub-pixel, a green sub-pixel and a blue sub-pixel.

13. The display device according to claim 12, wherein each of the first pixel set and the second pixel set of the display panel further comprises a yellow sub-pixel.

14. The display device according to claim 12, wherein each of the first pixel set and the second pixel set of the display panel further comprises a white sub-pixel.

15. A driving method of a display panel, comprising:

dividing pixels on the display panel into a plurality of pairs of pixel sets; wherein each of the pairs of the pixel sets comprises a first pixel set comprising three different color sub-pixels and a second pixel set comprising three different color sub-pixels, and the first pixel set and the second pixel set neighbor each other; wherein the first pixel set and the second pixel set are disposed in the same row and neighbor upon each other or disposed in the same column and neighbor upon each other; wherein the first pixel set in one pair of the pixel sets of the neighboring two pairs of the pixel sets and the second pixel set in the other pair of the pixel sets of the neighboring two pairs of the pixel sets neighbor upon each other;

acquiring, by looking up a table recorded inside a hardware cache of the display panel, a first voltage signal and a second voltage signal corresponding to each of the sub-pixels according to a frame input signal corresponding to a frame and a predetermined rule;

wherein the first voltage signal is unequal to the second voltage signal and a difference between the first voltage signal and the second voltage signal is greater than a predetermined difference range; and the first voltage signal and the second voltage signal alternately drive the sub-pixel to reach a positive viewing-angle mixed brightness equivalent to a positive viewing-angle brightness of the sub-pixel driven by the frame input signal; and the frame comprises a first frame and a second frame at neighboring timings;

adopting the first voltage signals for the color sub-pixels corresponding to the first pixel set to respectively drive the color sub-pixels of the first pixel set, and adopting the second voltage signals for the color sub-pixels corresponding to the first pixel set to respectively drive the color sub-pixels of the second pixel set upon displaying the first frame; and adopting the second voltage signals for the color sub-pixels corresponding to the second pixel set to respectively drive the color sub-pixels of the first pixel set, and adopting the first voltage signals for the color sub-pixels corresponding to the second pixel set to respectively drive the color sub-pixels of the second pixel set upon displaying the second frame, wherein, the frame input signal of the sub-pixel is decomposed into a first voltage frame and a second voltage frame, and the first voltage frame and the second voltage frame are displayed in order at neighboring two frames such that the synthesis effect of the first voltage frame and the second voltage frame is equivalent to the brightness of each of the sub-pixels of the original frame.

* * * * *